US007551876B2

(12) United States Patent
Kurita

(10) Patent No.: US 7,551,876 B2
(45) Date of Patent: Jun. 23, 2009

(54) IMAGE FORMING APPARATUS FEATURING ACCURATE POSITIONING OF AN INTERMEDIATE TRANSFER ROLLER RELATIVE TO A MAIN BODY OF THE APPARATUS

(75) Inventor: Shigeharu Kurita, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 200 days.

(21) Appl. No.: 11/262,766

(22) Filed: Nov. 1, 2005

(65) Prior Publication Data

US 2006/0099008 A1 May 11, 2006

(30) Foreign Application Priority Data

Nov. 11, 2004 (JP) ..... 2004-327564

(51) Int. Cl.
*G03G 15/00* (2006.01)

(52) U.S. Cl. ..... 399/110; 399/124; 399/302; 399/308

(58) Field of Classification Search ..... 399/110, 399/124, 302, 308
See application file for complete search history.

(56) References Cited

U.S. PATENT DOCUMENTS

| | | | | |
|---|---|---|---|---|
| 5,119,134 | A * | 6/1992 | Haneda et al. | 399/116 |
| 5,140,369 | A * | 8/1992 | Haneda et al. | 399/112 |
| 6,343,198 | B1 * | 1/2002 | Sato | 399/121 |
| 6,571,073 | B1 * | 5/2003 | Suzuki et al. | 399/124 |
| 6,801,742 | B1 * | 10/2004 | Mochimaru et al. | 399/124 |
| 6,996,354 | B2 * | 2/2006 | Kimura et al. | 399/121 |
| 2003/0235430 | A1 * | 12/2003 | Koshida | 399/124 |
| 2004/0101328 | A1 * | 5/2004 | Kimura et al. | 399/116 |
| 2004/0208670 | A1 * | 10/2004 | Abe | 399/110 |
| 2006/0002738 | A1 * | 1/2006 | Kurita | 399/124 |
| 2006/0104661 | A1 * | 5/2006 | Nakanishi | 399/124 |
| 2006/0104662 | A1 * | 5/2006 | Kawasumi | 399/124 |

FOREIGN PATENT DOCUMENTS

| | | |
|---|---|---|
| JP | 8-137181 | 5/1996 |
| JP | 2001-343843 | 12/2001 |
| JP | 2002-148968 | 5/2002 |
| JP | 2002-304032 | 10/2002 |
| JP | 2003-156984 | 5/2003 |
| JP | 2004-29211 | 1/2004 |
| JP | 2004-287017 | 10/2004 |
| JP | 2005-148411 | 6/2005 |

* cited by examiner

*Primary Examiner*—David M Gray
*Assistant Examiner*—Ryan D Walsh
(74) *Attorney, Agent, or Firm*—Fitzpatrick, Cella, Harper & Scinto

(57) ABSTRACT

An image forming apparatus includes an image bearing member which bears a toner image; an intermediate transfer member on which the toner image on the image bearing member is primary transferred; an intermediate transfer unit which supports the intermediate transfer member to allow rotation of the intermediate transfer member; a secondary transfer member which secondly transfers the toner image on the intermediate transfer member to a recording medium; a main body frame including at least the secondary transfer member; an opening unit which supports the intermediate transfer unit and which allows the intermediate transfer member to swing relative to the main body frame by pivoting on a rotation axis on the main body frame, thereby exposing the intermediate transfer unit when the intermediate transfer unit swings away from the main body frame; and a fitting portion which fits with the intermediate transfer unit, the fitting portion being disposed on the main body frame at a nearer portion to the intermediate transfer member than the rotation axis.

12 Claims, 8 Drawing Sheets

IMAGE FORMING APPARATUS FEATURING ACCURATE POSITIONING OF AN INTERMEDIATE TRANSFER ROLLER RELATIVE TO A MAIN BODY OF THE APPARATUS

BACKGROUND OF THE INVENTION

1. Field of the Invention

The present invention relates to an image forming apparatus such as a copying machine, a printer, a recording apparatus, and the like, and more specifically relates to a construction for positioning an intermediate transfer belt.

2. Related Background Art

An image forming apparatus for recording an image while conveying a sheet may be so constructed that a part of the apparatus can be swingably opened and closed, for the purpose of removing a jammed sheet or exchanging an internal unit. On this occasion, a part of the apparatus constructing the image forming apparatus, such as a sheet conveying unit, a fixing unit and the like may be disposed on a swing section serving also as an outer package.

For example, the image forming apparatus comprises an intermediate transfer belt as a belt member, a first swing section for supporting a fixing unit, a secondary transfer roller as a sheet conveying unit and the like and forming a part of an output tray, and a second swing section for supporting an intermediate transfer belt, in which the first swing section and the second swing section are so constructed as to swing around different fulcrum shafts, respectively.

In a swing construction shown in Japanese Patent Application Laid-Open No. 2003-156984 (FIG. 6, FIG. 8, and FIG. 10), the intermediate transfer belt is directly fixed to the second swing section. Therefore, the intermediate transfer belt is positioned through at least two parts of a chassis which bears the fulcrum shaft of the second swing section, and the second swing section.

Further, similarly, the secondary transfer roller also is positioned through at least two parts of a chassis which bears the fulcrum shaft of the first swing section for supporting the secondary transfer roller, and the first swing section.

That is, stabilization of the output image requires that the intermediate transfer belt and the secondary transfer roller abut each other with a high accuracy of position. However, according to the above-mentioned construction, the accuracy of position of the secondary transfer roller with respect to the intermediate transfer belt depends on the accuracies of the respective parts and the attaching accuracies of all the chassis (the rotating fulcrum shaft of the second rotating section), the chassis (the rotating fulcrum shaft of the first rotating section), and the first rotating shaft.

On this occasion, a problem has been caused as a result of the accuracy of position of the intermediate transfer belt lowering with respect to an apparatus main body, when the intermediate transfer belt and the secondary transfer roller are abutted to each other.

SUMMARY OF THE INVENTION

The invention has been achieved in view of the above-mentioned points. It is, therefore, an object of the invention to provide an image forming apparatus for forming an image using an intermediate transfer member, and that is capable of improving the accuracy of position of the intermediate transfer member with respect to an apparatus main body.

Further, it is another object of the invention to provides an image forming apparatus comprising an image bearing member that bears a visible image; an intermediate transfer member onto which the visible image on the image bearing member is transferred; a transfer unit which transfers the visible image on the intermediate transfer member onto a recording material; an intermediate transfer unit which includes the intermediate transfer member; and an opening and closing member what is capable of opening and closing with respect to an apparatus main body, wherein the intermediate transfer unit is swingably supported by the opening and closing member, and then positioned by the apparatus main body when the opening and closing member is closed.

DETAILED DESCRIPTION OF THE EMBODIMENTS

According to the invention, the intermediate transfer unit is swingably supported by the opening and closing member, and positioned by the apparatus main body when the opening and closing member is closed; therefore, it is possible of improve the accuracy of position of the intermediate transfer member with respect to the apparatus main body to thereby stabilize the output image.

The invention will be described in detail hereinafter.

The image forming apparatus according to an embodiment of the invention will be described with reference to the drawings.

[Overall Structure of the Image Forming Apparatus]

An overall structure of an image forming apparatus will be described hereinbelow with reference to FIG. 1, which is a view showing an arrangement an image forming apparatus according to the present embodiment.

Figure 1:
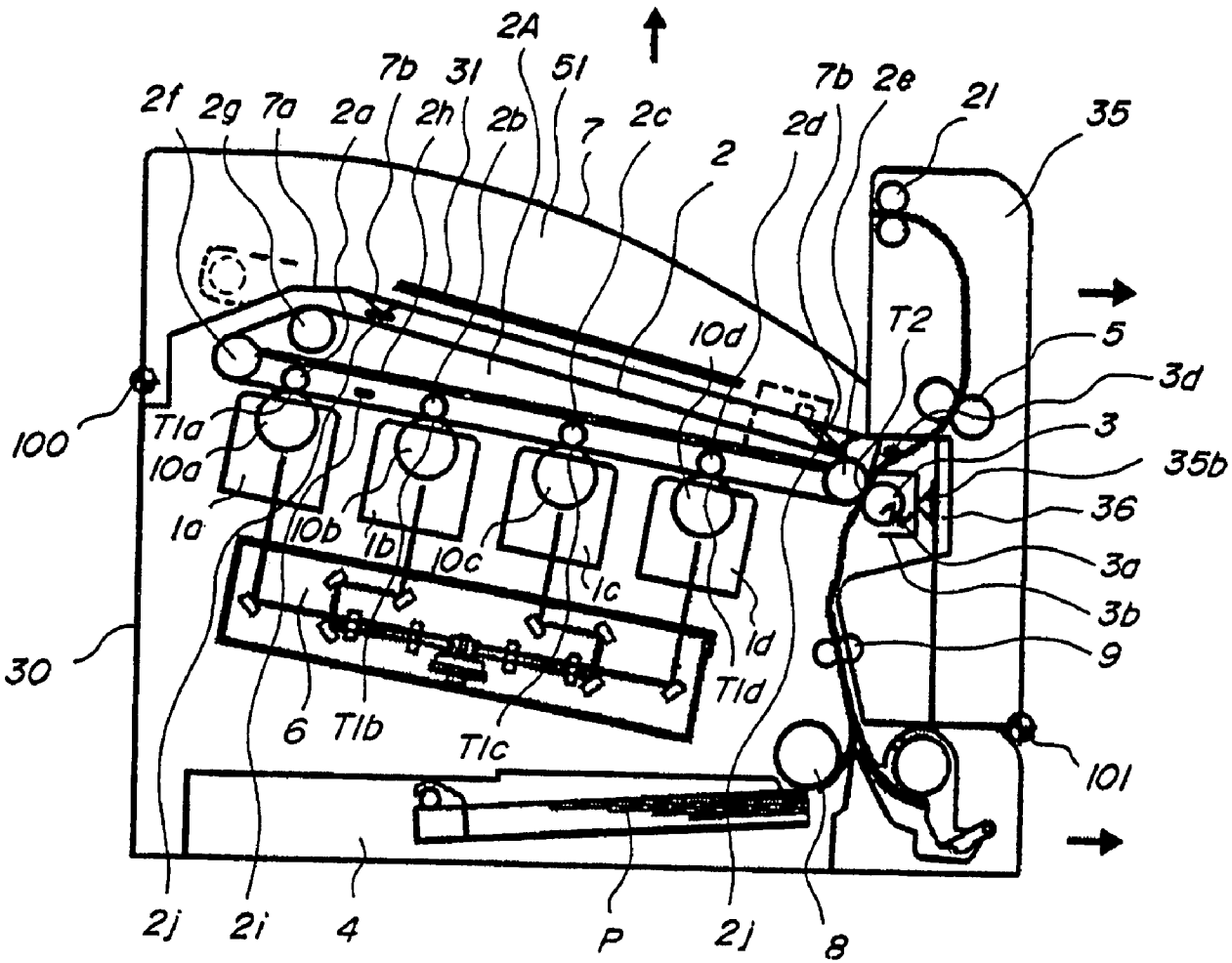
FIG. 1 is a view showing an overall structure of an image forming apparatus.

An image forming apparatus shown in FIG. 1 has four photosensitive drums 10*a*, 10*b*, 10*c*, 10*d*, as image bearing members, for bearing toner images (visible images) of yellow, magenta, cyan, and black. Around each of the photosensitive drums 10*a* to 10*d* are arranged a charger, a development unit, and a cleaner (all not shown), which are unitized as a process cartridge 1*a*, 1*b*, 1*c*, and 1*d*. An intermediate transfer belt 2, as an example of a belt member which is an intermediate transfer member, is disposed above the process cartridges 1*a* to 1*d* so as to contact the respective photosensitive drums 10*a* to 10*d*.

The chargers (not shown) charge photosensitive drums 10*a* to 10*d*, respectively. An exposing unit 6 exposes optical images of yellow, magenta, cyan, and black colors to form yellow, magenta, cyan, and black latent images. The development unit develops the respective latent images to thereby form yellow, magenta, cyan, and black toner images on the photosensitive drums 10*a* to 10*d*.

The rotation of the photosensitive drums 10*a* to 10*d* causes the toner images to reach primary transfer sections at which the photosensitive drums 10*a* to 10*d* abut to the intermediate belt 2. These toner images are sequentially transferred to the intermediate transfer belt 2 by the primary transfer rollers (primary transfer units) 2*a*, 2*b*, 2*c*, and 2*d* which are disposed so as to be opposed to the respective photosensitive drums 10*a* to 10*d*. The toner images are transferred from the photosensitive drums 10*a* to 10*d* at the primary transfer sections T1*a* to T1*d*. To the primary transfer rollers 2*a*, 2*b*, 2*c*, 2*d* are applied primary transfer biases from an electrical equipment board.

Sheets (recording materials) P contained in a sheet cassette 4 are fed one by one by a pick-up roller 8. And then timed by a registration roller 9. Thereafter, the sheet P is conveyed up to a nip section (a secondary transfer section) T2 which is constructed by a secondary transfer roller (a transfer unit, a secondary transfer unit) 3 and the intermediate transfer belt 2, followed by the toner image on the intermediate transfer belt 2 being secondarily transferred in block to the sheet P.

Then, the sheet P having the transferred toner image is conveyed to a fixing unit 5, and hence subjected to heat and pressure by the fixing unit 5, thereby causing the not-yet-formed-toner image to be fixed to the sheet P, which causes the respective color toners to be molten and mixed in color to provide a full color print image fixed to the sheet P. Thereafter, the sheet P is discharged to an output tray 7, as a sheet discharging section, by a discharge and convey unit disposed at a location downstream of the fixing unit 5.

Thus constructed image forming apparatus according to the present embodiment has the sheet cassette 4, the exposing unit 6, and the process cartridges 1*a* to 1*d*, the intermediate transfer belt and the output tray 17, in the order named from a lower portion of an apparatus main body 30 to an upper portion. In the apparatus main body 30 is disposed a main electric equipment board for controlling the whole image forming apparatus including a fixed power supply. Further, an electrical equipment board 31 is disposed above the intermediate transfer belt 2 and below the output tray 7, for applying a transfer bias to the primary transfer roller 2*a* to 2*d* and the secondary transfer roller 3. On this occasion, the output tray 7 is a curved surface and is inclined from the downstream side to the upstream side with respect to a discharging direction of the discharge and convey unit 21, and then the electric equipment board 31 is disposed in a space formed between the output tray 7 and the intermediate transfer belt 2.

Besides, as to FIG. 1 showing the image forming apparatus according to this embodiment, the right-hand side shows a front operation side of the apparatus, and the left-hand side shows a rear side of the apparatus.

[Positioning of Intermediate Transfer Unit]

Next, a description will be given of a construction of positioning an intermediate transfer unit 2A having the intermediate transfer belt 2 in such a condition as that the intermediate transfer unit 2A is set to the main body.

The intermediate transfer belt 2 is tightly stretched due to tension rollers 2*e*, 2*f*, and 2*g*, and then there is provided a transfer frame 2*h* for supporting the tension rollers 2*e*, 2*f* and 2*g* and the primary transfer rollers 2*a*, 2*b*, 2*c*, and 2*d*, and the like. Moreover, the intermediate transfer belt 2, the primary transfer rollers 2*a*, 2*b*, 2*c*, and 2*d*, the tension rollers 2*e*, 2*f*, and 2*g*, and the transfer frame 2*h* are unitized as an intermediate transfer unit 2A.

The intermediate transfer unit 2A is, as will be described later, swingably supported on the discharge unit 51 having the output tray 7, but restricted, relative to main body side plates 11 (refer to FIG. 4) disposed in the apparatus main body 30, by a fitting section 11*b* (refer to FIG. 4) of the main body side plates 11 in the height direction and the forward-backward direction on a side of the tension roller 2*e*. Whereas, a pair of seats 2*i* (hereinafter simply referred to collectively as "seats 2*i*" and individually as "seat 2*i*") disposed on the transfer frame 2*h* is restricted by abutting to flat surfaces (not shown) of the main body side plates 11 in the height direction on a side of the tension roller 2*f*.

Further, the transfer frame 2*h* has seats 2*j* on a side of the tension roller 2*e* and on a side of the tension roller 2*f*, respectively, and the output tray 7 has elastic members such as a pair of dogleg line springs 7*b* (hereinafter simply referred to collectively as "line springs 7*b*" and individually as "line spring 7*b*") protruding from the output tray 7, or plate springs, or the like at locations opposed to the seats 2*j*.

According to the construction described above, on a side of one of the main body side plates 11 (described later), the line springs 7*b* of the output tray 7 abutting to the seats 2*j* of the transfer frame 2*h* enables the intermediate transfer unit 2A to be positioned in the height direction and the forward-backward direction by the fitting section 11*b* of the main body side plates 11*b* on a side of the tension roller 2*e* as the front operation side of the apparatus, and the seats 2*i* of the transfer frame 2*h* abutting to the flat surfaces (not shown) of the main body side plates 11 enables the intermediate transfer unit 2A to be positioned in the height direction on a side of the tension roller 2*f* as the rear operation side of the apparatus. Moreover, the main body side plates 11 are identical in shape with each other and disposed in the apparatus main body so as to be opposed to each other both left and right sides viewed from the front operation side of the apparatus.

On this occasion, the discharge unit 51 swingably supporting the intermediated transfer unit 2A and the fixing frame 35 having the fixing unit 5 are constructed to be swingably opened or closed with respect to the apparatus main body 30. That is, opening the discharge unit 51, as a first opening or closing member, allows the process cartridges 1*a* to 1*d* to be exposed, allowing easy exchange of the cartridges. Further opening the fixing frame 35, as a second opening and closing member, allows a sheet conveying path to be exposed, with easy removal of a jammed sheet.

Figure 2:
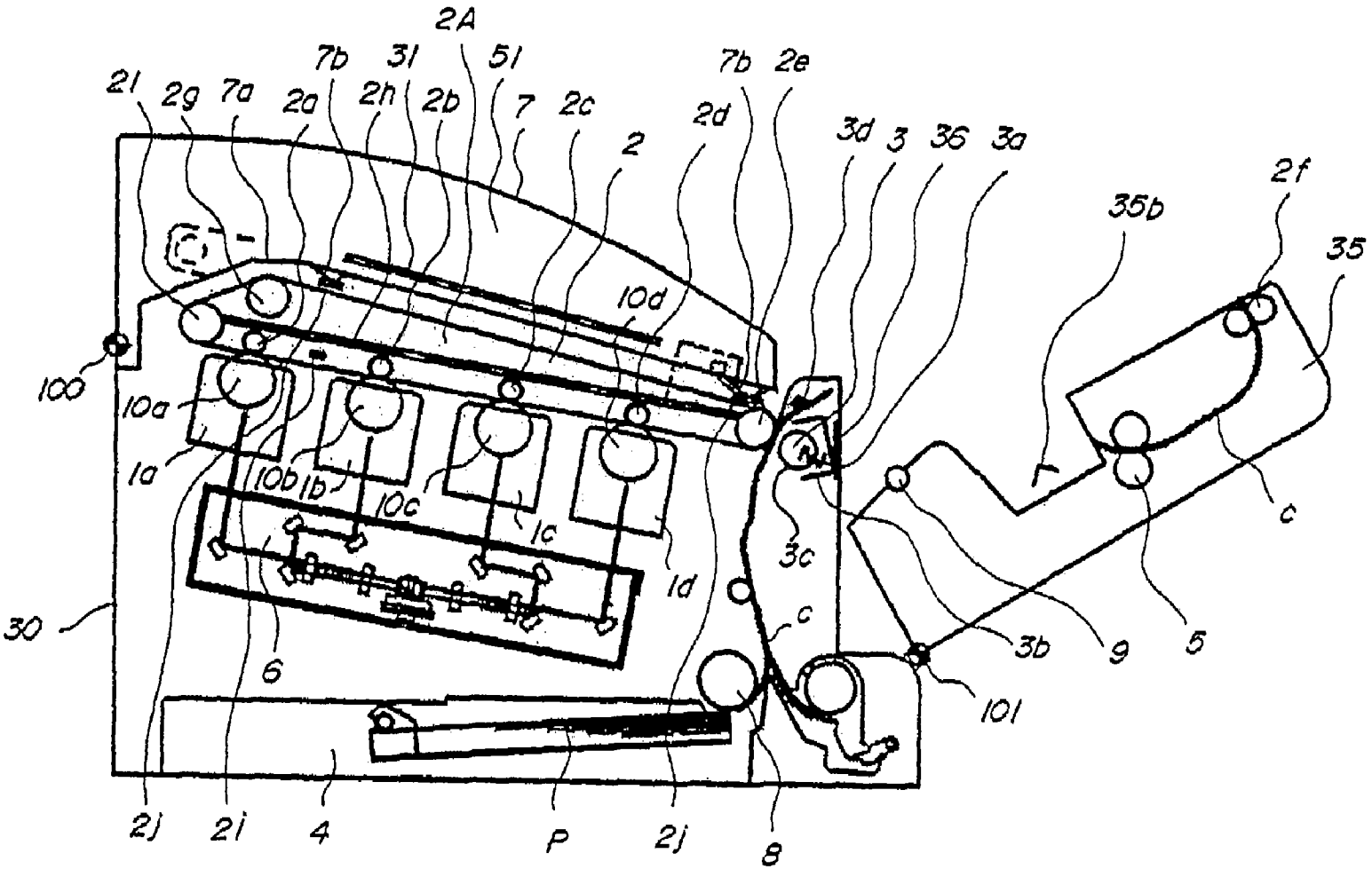
FIG. 2 is a sectional view of the image forming apparatus, showing a situation in which a fixing frame is opened.
Figure 3:
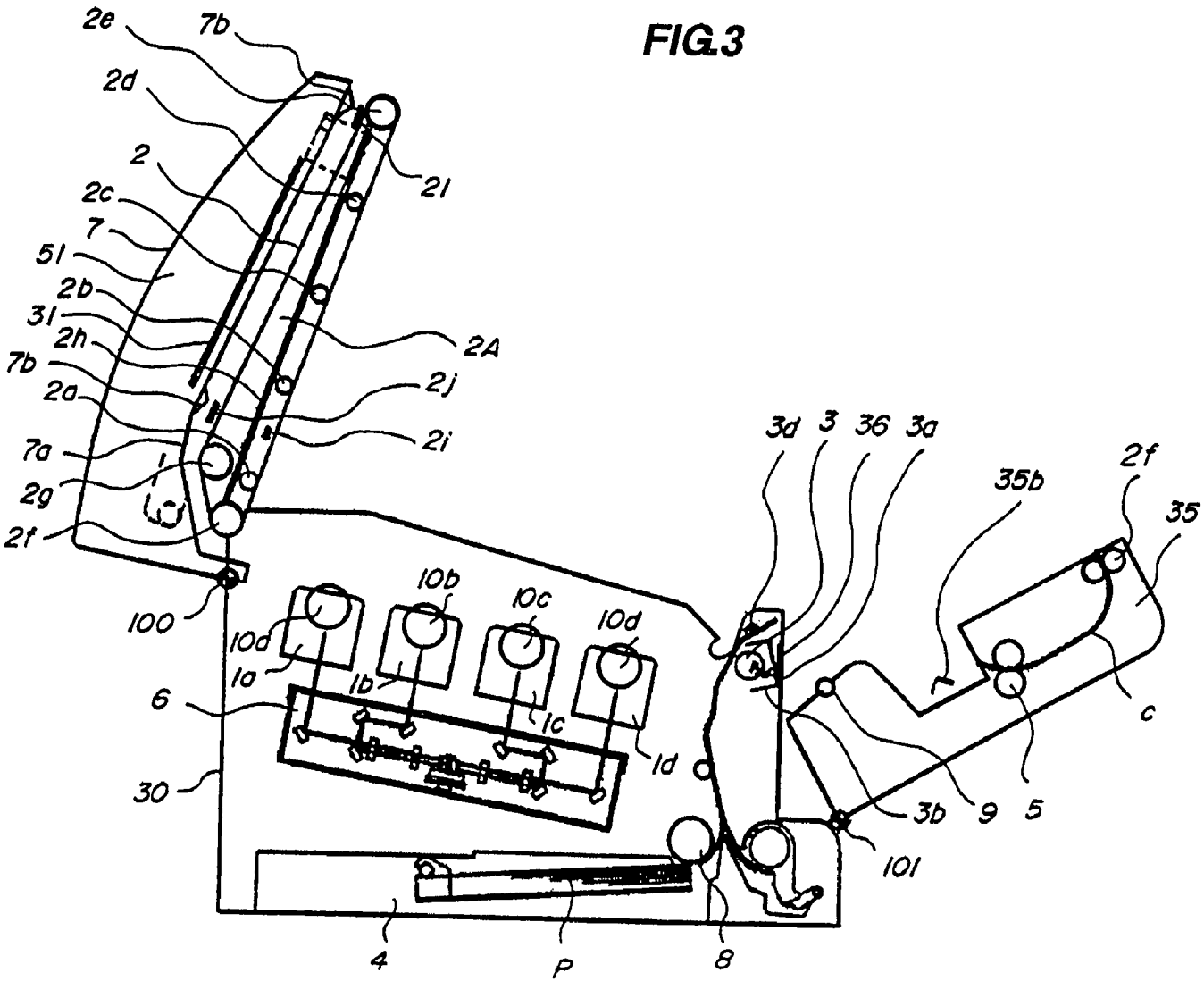
FIG. 3 is a sectional view of the image forming apparatus, showing a situation in which a fixing frame and a discharge unit are opened.

Next, a description will be given of a construction of opening and closing the fixing frame 35 and the discharge unit 51 as the above-mentioned opening and closing members. FIG. 2 is a sectional view of the image forming apparatus, showing a case in which the fixing frame 35 is opened, and FIG. 3 is a sectional view of the image forming apparatus, showing a case in which the discharge unit 51 is opened.

[Construction of Opening or Closing Fixing Frame]

As shown in FIG. 2, the fixing frame 35 is swingable in the embodiment. This fixing frame 35 is provided with the fixing unit 5 and a part of a sheet path C as an example of the sheet conveying path, and then is so constructed as to be swingable toward one side of the apparatus (on the front operation side of the apparatus in the embodiment) around the fulcrum shaft 101 disposed on the apparatus main body 30 on one side thereof.

Therefore, the apparatus is so constructed that opening the fixing frame 35 provides a jam clearance operation, when the sheet P fed by the pick-up roller 8 from the cassette 4 has been jammed while transferring and hence stacked within the sheet path C, or when the sheet P has been jammed in the fixing unit 5.

The secondary transfer roller 3, as a secondary transfer unit, is swingably supported on a holder 3*b* disposed on the apparatus main body 30, and urged toward the intermediate transfer belt 2 by compression springs 3*a*. The secondary transfer roller 3, the compression springs 3*a*, and the holder 3*b* construct a secondary transfer unit 3*c*.

Further, the secondary transfer roller 3*c* is swingably mounted onto the apparatus main body 30 and centered around a fulcrum shaft 3*d*. Then, the fulcrum shaft 3*d* is located at such a position as that the secondary transfer roller 3 is separated from the intermediate transfer belt 2, as shown in FIG. 2, when the secondary transfer roller unit 3*c* swings by its own weight during opening of the fixing frame 35.

Besides, a reinforcing member 36 connecting the main body side plate (reference numeral 11 in FIG. 4) and the side plate opposed thereto (not shown) to thereby construct a part of a main body frame is disposed between the secondary transfer roller unit 3*c* and the fixing frame 35. This reinforcing member 36 has an opening portion (not shown) at both end thereof with respect to its longitudinal direction (a direction perpendicular to a sheet of FIG. 2).

On the other hand, the fixing frame 35 has the dogleg line springs 35*b*, as examples of separating and contacting units, fixed thereto at locations opposite to the opening portions (not shown) of the reinforcing member 36. When the fixing frame 35 is closed, the line springs 35*b* urge the holder 3*b* through the opening portion (not shown) to swing the secondary transfer roller unit 3*c* around the fulcrum shaft 3*d*. The secondary transfer roller unit 3*c* abuts to a restriction section (not shown) disposed in the apparatus main body at a predetermined position, to thereby be positioned. That is, opening or closing the fixing frame 35 allows the secondary transfer roller 3 to separate from or contact the intermediate transfer belt 2.

According to the above-mentioned construction, as shown in FIG. 2, when opening the fixing frame 35, the secondary transfer roller 3 is separated from the intermediate transfer belt 2, thereby causing the sheet path C to be opened, which allows the jam clearance operation when the sheet P has been jammed before or after the nip section between the secondary transfer roller 3 and the intermediate transfer belt 2.

Further, when the sheet P has been jammed and hence staying in the fixing unit 5, opening the fixing frame 35 causes the secondary transfer roller 3 to separate from the intermediate belt 2, thereby allowing the sheet path C to be opened. Accordingly, the sheet P which is engaged in the fixing unit 5 can be pulled out. Therefore, operating the pressure releasing lever (not shown) in the fixing unit 5 to release the nip of the roller pair formed in the fixing unit 5 enables the sheet P stayed in the fixing unit 5, thereby facilitating the jam clearance operation.

[Construction of Opening or Closing Discharging Unit]

Besides, as shown in FIG. 3, the discharge unit 51 is swingable. That is, the discharge unit 51 swingably supported in the apparatus main body around the fulcrum shaft 101 disposed in the apparatus main body on an opposite side (a rear side of the apparatus in this embodiment) to the fulcrum shaft 101 of the fixing frame 35. This discharge unit 51 is integral with the discharge frame 7*a* as one body, and then has the output tray 7 formed on an upper surface thereof Further, the intermediate transfer belt 2 is engaged with the discharge unit 51 by an engaging section (not shown).

Therefore, opening the discharge unit 51 around the fulcrum shaft 100 disposed on the apparatus main body 30 causes the intermediate transfer belt 2 to be exposed in conjunction with the discharge unit 51; therefore, when exchanging the process cartridges 1*a* to 1*d* as consumable goods, simply opening the discharge unit 51 leads to accessing to the process cartridges 1*a* to 1*d*.

[Positioning Construction]

Next, a description will be given of a construction of positioning the intermediate transfer unit 2A. FIGS. 4 to 8 are views which are useful in explaining operations of the main part from a state in which the discharge unit 5 is opened to a state in which the discharge unit 5 is set to a predetermined position.

In FIGS. 4 to 8, a guide section 11*a* for guiding the intermediate transfer unit 2A when the discharge unit 51 is opened or closed and fitting section 11*b* for use in positioning is disposed on the main body side plates 11 provided on the apparatus main body in the vicinity of the secondary transfer roller 3. Further, there is provided an engaging section 11*c* with which the secondary transfer unit 2A is engaged in such a manner that, when the discharge unit 51 and the fixing frame 35 are closed, a pressure force due to the secondary transfer roller 3 inhibits the intermediate transfer unit 2A from separating from the fitting section 11*b*.

Moreover, the process cartridges la to Id have ball bearings 30*a*, 30*b*, 30*c*, and 30*d* at both ends of the photosensitive drums 10*a* to 10*d*, respectively. Outer races of the ball bearings are pulled into fitting sections 32*a*, 32*b*, 32*c*, and 32*d* while being guided by drum guide sections 31*a*, 32*b*, 32*c*, and 32*d* of the main body side plates 11, and then locked by locking members (not shown). That is, the process cartridges 1*a* to 1*d* are so constructed as to be positioned directly onto the main body side plates 11, respectively.

Figure 4:
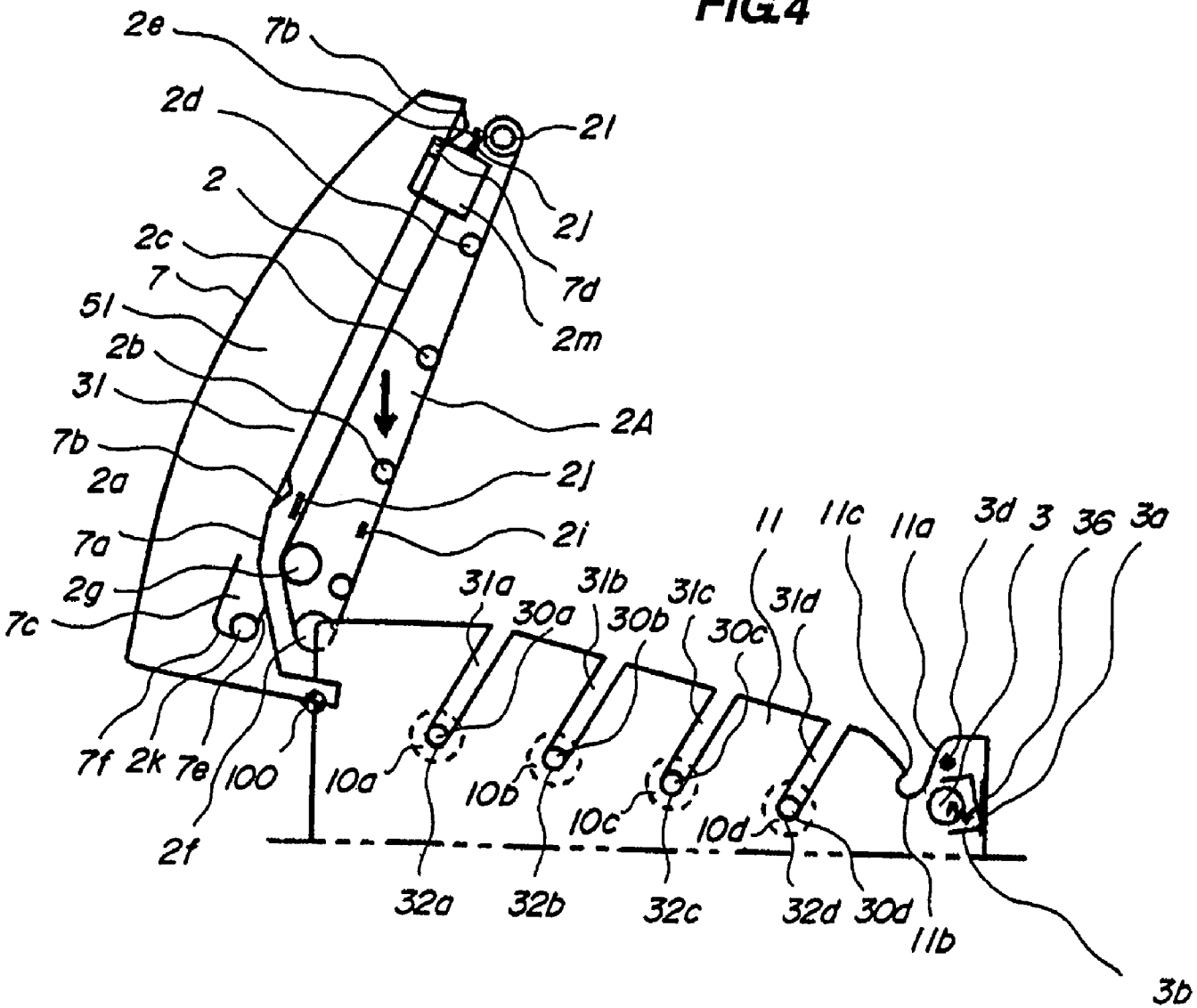
FIG. 4 is a view which is useful in explaining an operation of the discharge unit, showing a situation in which the discharge unit is going to be closed with respect to the apparatus main body.

The intermediate transfer unit 2A is swingably mounted onto the discharge unit 51. As shown in FIG. 4, in a state in which the discharge unit 51 is opened swingably around the fulcrum shaft 100, bosses 2*k* disposed on the intermediate transfer unit 2A are guided along and then incorporated into U-shaped guides 7*c* of the discharge unit 51. Further, on a front operation side of the discharge unit 51 (an opposite side to the fulcrum shaft 100), locking members 2*m* of the intermediate transfer unit 2A are engaged with claw sections 7*d* of the discharge unit 51 at inner portions thereof, thereby preventing the intermediate transfer unit 2A from dropping out of the discharge unit 51, and enabling the locking members 2*m* to be easily disengaged, which improves the exchangeworkability of the intermediate transfer unit 2A.

On this occasion, as shown in FIG. 4, since the intermediate transfer unit 2A is not fixed when the discharge unit 51 is opened, the intermediate transfer unit 2A is apt to drop due to its own weight in such a direction as to close the discharge unit 51; however, the intermediate transfer unit 2A is maintained in position because the bosses 2*k* abut to inner wall surfaces 7*e*, 7*f* of the U-shaped guides 7*c* and the locking members 2*m* are separated from the output tray 7 within such a range as that it is capable of engaging with the claw sections 7*d*.

Figure 5:
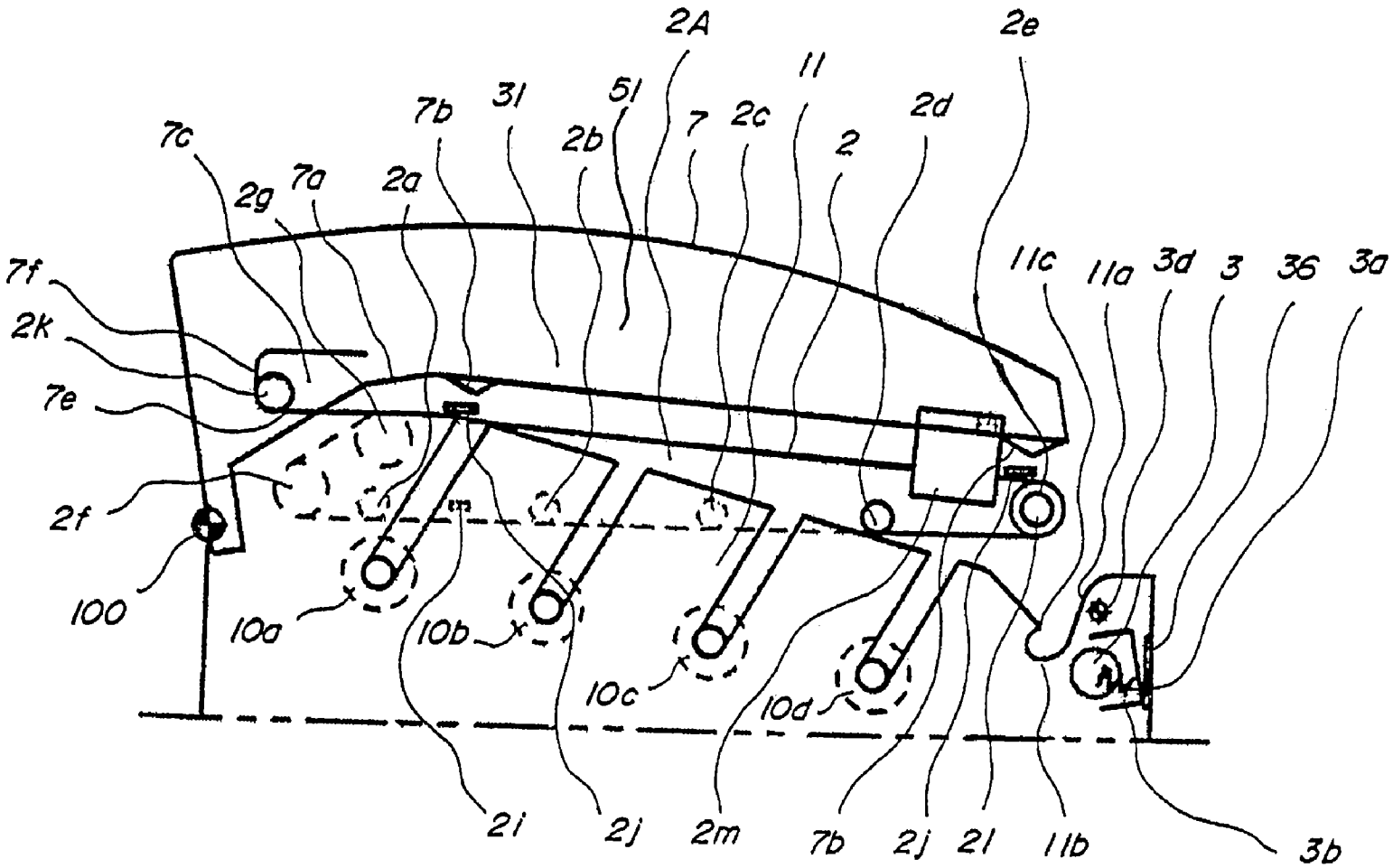
FIG. 5 is a view which is useful in explaining an operation of the discharge unit, showing a situation in which the discharge unit is going to be closed with respect to the apparatus main body.

FIG. 5 shows a state in which the intermediate transfer unit 2A is closed swingably around the fulcrum shaft 100 until its primary transfer plane is located in a horizontal position from a state in which the discharging unit 51 is opened shown in FIG. 4. The intermediate transfer unit 2A swings while the bosses 2*k* abutting to the wall surfaces 7*e*, 7*f* of the guides 7*c* from the opening state to the horizontal state.

Figure 6:
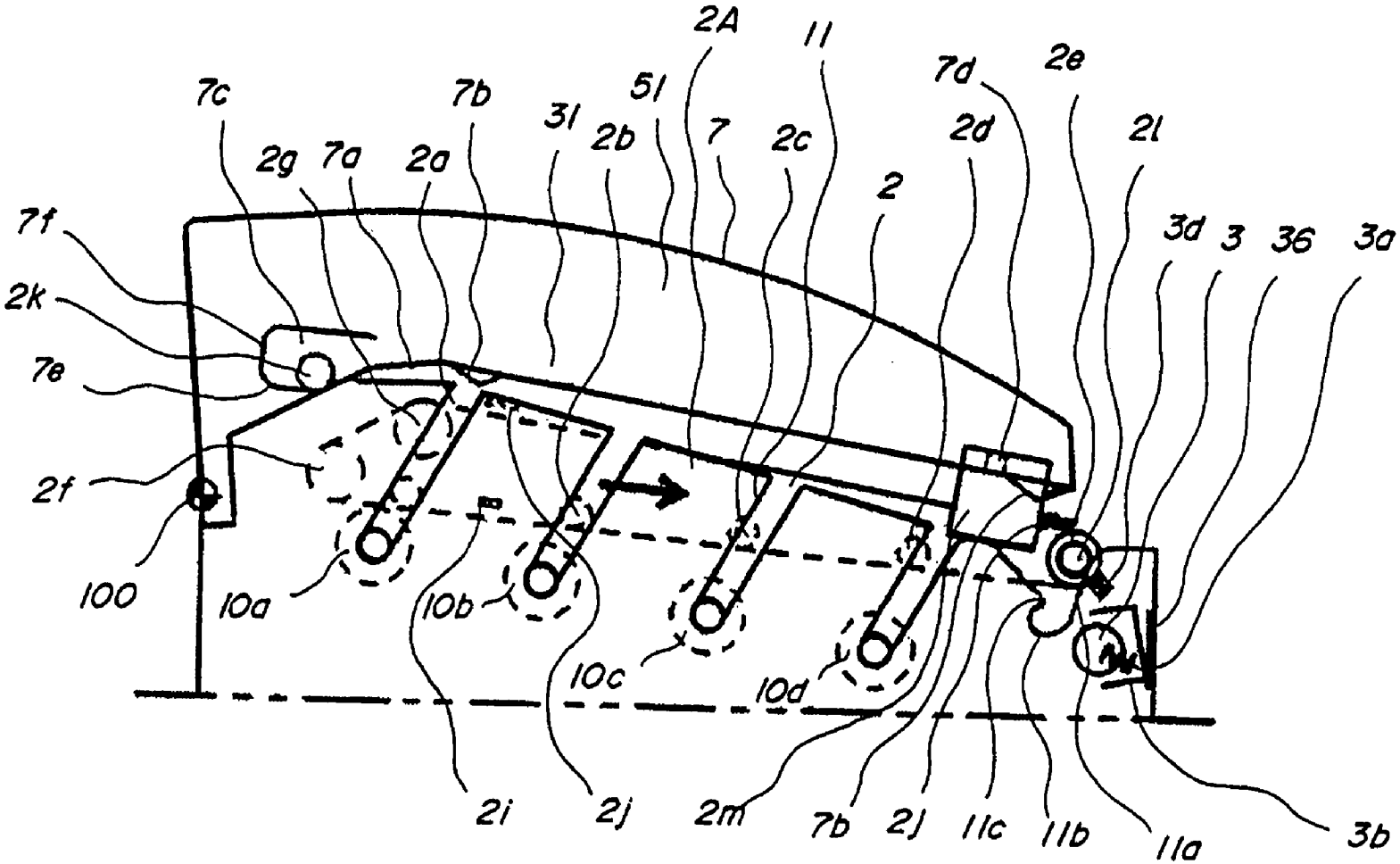
FIG. 6 is a view which is useful in explaining an operation of the discharge unit, showing a situation in which the discharge unit is going to be closed with respect to the apparatus main body.
Figure 7:
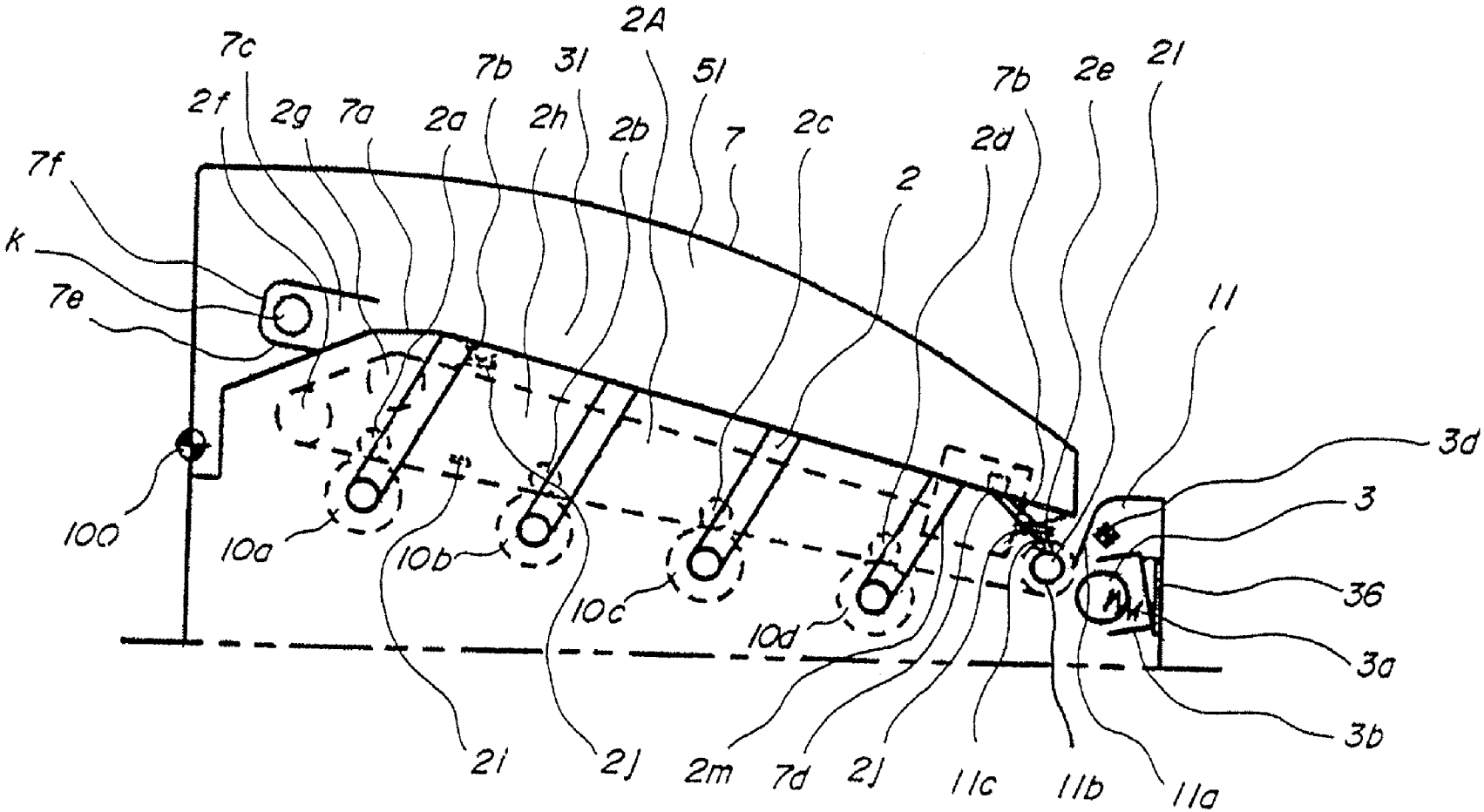
FIG. 7 is a view which is useful in explaining an operation of the discharge unit, showing a case in which the discharge unit is going to be closed with respect to the apparatus main body.

On this occasion, the intermediate transfer unit 2A is adapted to be declined toward the secondary transfer roller 3, when the discharge unit 51 is closed, (refer to FIG. 7). To this end, the intermediate transfer unit 2A is, due to its own weight or a swing operation such as a sudden closing operation of the discharge unit 51, deemed to move toward the front operation side of the discharge unit 51 (an opposite side to the fulcrum shaft 100) before the primary transfer plane reaches substantially the horizontal direction position, followed by acting as shown in FIG. 6 and later.

In FIG. 6, reference numeral 21 designates ball bearings, as section-to-be-fitted, disposed in the intermediate unit 2A, for positioning the intermediate transfer unit 2A onto the main body side plates 11. These ball bearings 21 are coaxial with the tension roller 2*e*, and disposed at both ends of the tension roller 2*e*. FIG. 6 shows one of the ball bearings 21. When closing the discharge unit 51 lower than a state shown in FIG. 5, the intermediate transfer unit 2A moves toward the secondary transfer roller 3 due to its own weight. Moreover, its moving amount is set due to a play between one of the locking members 2*m* and one of the claw sections 7*d*.

On this occasion, FIG. 6 which shows one side of the apparatus, and more specifically shows that the boss 2*k* of the intermediate transfer unit 2A abuts to the wall surface 7*e* of the guide 7*c*; however, the seat 2*i* and the flat surface of the main body side plate 11 may be set in position in such a manner that the seat 2*i* of the transfer frame 2*h* on a side of the fulcrum shaft 100 abuts to the flat surface (not shown) of the main body side plate 11.

Swinging the discharge unit 51 in a closing direction causes the outer race of the ball bearing 21 to be introduced into the fitting section 11*b* and the engaging section 11*c* as shown in FIG. 7, while abutting to the guide section 11*a* of the main body side plate 11, which realizes the positioning on a side of the secondary transfer roller 3 of the intermediate transfer unit 2A.

As described above, on an opposite side (on a side of the fulcrum shaft 100) to the secondary transfer roller 3, the seat 2*i* of the transfer frame 2*h* abuts to the flat surface (not shown) of the main body side plate 11, thereby resulting the positioning in the height direction. Then, the line spring 7*b* of the discharge unit 51 abuts to the seat 2*j*, thereby causing the intermediate transfer unit 2A to be fixed.

Figure 8:
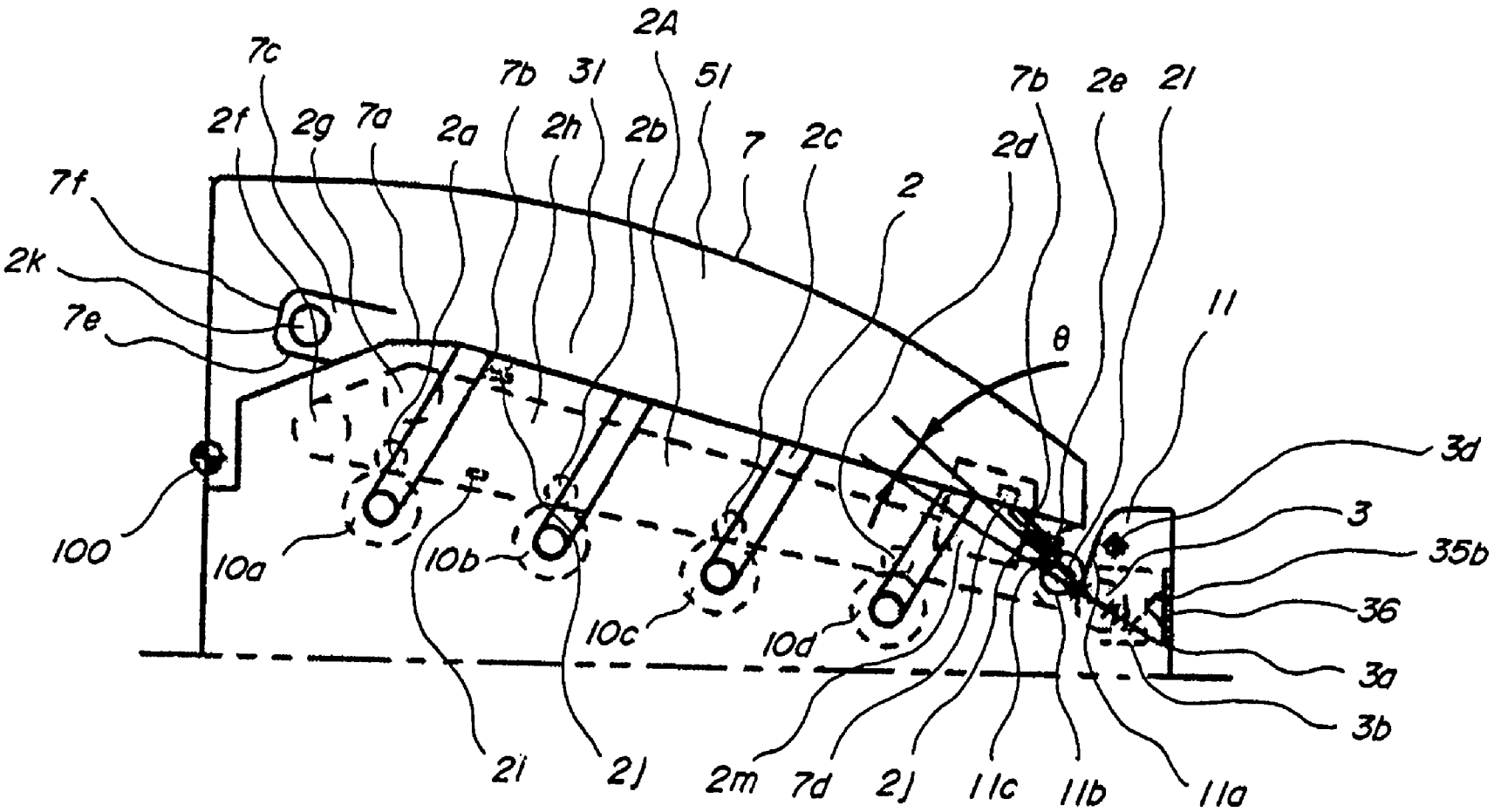
FIG. 8 is a view which is useful in explaining an operation of the discharge unit, showing a situation in which the discharge unit is closed with respect to the apparatus main body.

FIG. 8 shows a state in which the discharge unit 51 is closed and then fixed to the apparatus main body, before the fixing frame 35 is closed. Closing the fixing frame 35 causes the line spring 35*b* to urge the holder 3*b* as described above, thereby causing the secondary transfer roller unit 3*c* to swing around the fulcrum shaft 3*d*. Then, the secondary transfer roller 3 abuts, through the intermediate transfer belt 2, the tension roller 2*e* which is coaxial with the ball bearing 21, as a main positioning member of the intermediate transfer unit 2A.

Here, in order that the outer race of the ball bearing 21 of the intermediate transfer unit 2A is reliably fitted to in a state in which the discharge unit 51 and the fixing frame 35 are closed, the engaging section 11*c* is formed in the main body side plate 11 in such a manner that the outer race of the ball bearing 21 is engaged with the fitting section 11*b* by an extra amount of θ in FIG. 8 with respect to pressuring direction of the secondary transfer roller 3 to the tension roller 2*e*. This prevents the ball bearing 21 from being disengaged with the fitting section 11*b*, thereby ensuring the accuracy of position of the intermediate transfer unit 2A with respect to the main body frame.

Moreover, the above-mentioned embodiment is exemplified by the opening and closing member being adapted to be capable of opening and closing by swinging of the opening and closing member; however, the opening and closing member may be adapted to be capable of opening and closing by sliding of the opening and closing member.

As described above, according to the image forming apparatus of this embodiment, the discharge unit 51 is opened together with the intermediate transfer belt 2 to a position above the apparatus main body, and then the intermediate transfer belt 2 is swingably engaged with the discharge unit 51 without directly being fixed thereto; therefore, it is possible to remove the intermediate transfer belt 2 from the discharge unit 51 easily, which improves the exchange-workability.

Further, since it is so constructed as to be declined toward the secondary transfer roller 3 when closing the discharge unit 51, the intermediate transfer unit 2A, during closure of the discharge unit 51, slides with respect to the discharge unit 51 due to its own weight, and is guided along and then positioned by the positioning section of the main body. That is, the positioning needs only a construction of forming a guiding shape and a fitting shape of the main body side plates 11 suitably, thereby making this construction simple to prevent the parts count from increasing and further prevents increase in cost.

Moreover, since the fitting section 11*b* for positioning the intermediate transfer unit 2A by fitting with the ball bearing 21 disposed in the intermediate transfer unit 2A has the engaging section 11*c* for preventing the intermediate transfer unit 2A from moving against the pressing force of the secondary transfer roller 3, it is capable of positioning, reliably, the tension roller 2*e* supporting the intermediate transfer belt 2 which is pressed by the secondary transfer roller 3. This resolves a deviation of the alignment between the belt tension roller 2*e* and the secondary transfer roller 3, thereby eliminating image-relevant influences such as color drift, defective transfer, or the like, and sheet conveyability-relevant influences such as skew, oblique passing, or the like, which results in stabilization of the output image.

Further, since the intermediate transfer belt 2 and the photosensitive drum are positioned directly on the main body side plates, only ensuring the accuracy of position of the primary transfer roller in the intermediate transfer unit 2A resolves the defective transfer due to the position deviation between the photosensitive drum and the primary transfer roller.

If the exposing unit is fixed to the bottom plates connecting between the main body side plates, the intermediate transfer belt, the photosensitive drum, the exposing unit, and the secondary transfer roller are directly positioned on the main body frame; therefore, it is possible to determine the positional deviation between the respective elements only by the accuracy of the main body frame, thereby resulting in further stabilization of the output image.

Further, the fulcrum shaft 100 of the discharge unit 51 and the fulcrum shaft 101 of the fixing frame 35 are disposed in the apparatus main body, respectively, and one of the rotating fulcrum shaft 101 is disposed on the front operational side of the apparatus main body and the other of the fulcrum shaft 100 is disposed on the rear side of the apparatus main body; therefore, opening the discharge unit 51 and the fixing frame 35 enables the whole apparatus to be opened, and then facilitates a process cartridge exchange and a jam clearance operation.

Further, since the secondary transfer roller 3 is so constructed as to be swingable with respect to the apparatus main body and press the intermediate transfer belt 2 when the fixing frame 35 is closed with the discharge unit 51 closed, the secondary transfer roller 3 presses the positioned intermediate transfer belt 2, thereby enabling both the secondary transfer roller 3 and the intermediate transfer shaft 2 to abut to each other at a high accuracy of position.

Further, since the intermediate transfer unit 2A is swingably engaged with the discharge unit 51 without directly being fixed thereto and then the intermediate transfer belt is positioned by the main body side plates, even if an operator wrongly touches or gives an impact to the output tray, the adding vibration does not directly transmit to the intermediate transfer belt 2, which results in stabilization of the output image.

CROSS-REFERENCE TO RELATED APPLICATION

This application claims the benefit of priority from the prior Japanese Patent Application No. 2004-327564 filed on Nov. 11, 2004 the entire contents of which are incorporated by reference herein.

What is claimed is:

1. An image forming apparatus comprising;

an image forming unit including an image bearing member which bears a toner image;

an intermediate transfer member on which the toner image on the image bearing member is primary transferred;

a first transfer member which contacts with a toner bearing side of the intermediate transfer member;

a second transfer member which contacts with an inside of the intermediate transfer member and forms a transfer portion to press the first transfer member via the intermediate transfer member, for transferring an image on the intermediate transfer member to a recording medium;

an opening-closing member which holds the intermediate transfer member to be able to be swung, the opening-closing member swinging to separate the intermediate transfer member from the image forming unit; and a positioning portion disposed on an image forming apparatus main body, for fixing a position of the second transfer member by connecting with the second transfer member when the intermediate transfer member is fixed on the image forming apparatus main body.

2. An image forming apparatus according to claim 1, further comprising a fulcrum shaft for supporting the opening and closing member, the opening and closing member being rotatable around the fulcrum shaft.

3. An image forming apparatus according to claim 2, wherein the fulcrum shaft is disposed at an opposite side of the image forming apparatus for the second transfer member in a horizontal direction.

4. An image forming apparatus according to claim 1, further comprising a pressure releasing member for releasing a pressure from the first transfer member to the intermediate transfer member when the intermediate transfer member is fixed at a position for forming an image.

5. An image forming apparatus according to claim 1, further comprising:

a conveyance portion which conveys recording medium; and a second opening-closing member for opening and closing the conveyance portion.

6. An image forming apparatus according to claim 5, wherein the opening-closing member is disposed at an upper portion of the image forming apparatus and the second opening-closing member is disposed at a side portion of the image forming apparatus.

7. An image forming apparatus according to claim 5, further comprising a pressure releasing member for releasing a pressure from the first transfer member to the intermediate transfer member, disposed on the second opening-closing member, when the intermediate transfer member is fixed at a position for forming an image.

8. An image forming apparatus according to claim 1, further comprising a exposing unit which illuminates exposing lights to the image bearing member, the exposing unit disposed below the image forming unit.

9. An image forming apparatus according to claim 1, wherein the opening-closing unit has a elastic member which presses the intermediate transfer member toward the image forming apparatus main body, when the intermediate transfer member is fixed on the image forming apparatus main body.

10. An image forming apparatus according to claim 1, wherein the positioning portion is formed on a side plate of the image forming apparatus main body.

11. An image forming apparatus according to claim 10, wherein the side plate includes a connecting portion.

12. An image forming apparatus according to claim 10, wherein the side plate has a supporting portion which supports the image forming portion being lower than the intermediate transfer member in a vertical direction.

* * * * *